US010585375B2

(12) United States Patent
Nagashima

(10) Patent No.: US 10,585,375 B2
(45) Date of Patent: Mar. 10, 2020

(54) IMAGE FORMING APPARATUS INCLUDING EXPOSURE DEVICE WHICH FORMS ELECTROSTATIC LATENT IMAGE ON PHOTOSENSITIVE DRUM

(71) Applicant: KYOCERA Document Solutions Inc., Osaka (JP)

(72) Inventor: Teruhiko Nagashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/253,630

(22) Filed: Jan. 22, 2019

(65) Prior Publication Data

US 2019/0265616 A1 Aug. 29, 2019

(30) Foreign Application Priority Data

Feb. 28, 2018 (JP) ..... 2018-034890

(51) Int. Cl.

*G03G 15/16* (2006.01)
*G03G 15/04* (2006.01)
*G03G 15/00* (2006.01)

(52) U.S. Cl.

CPC ... *G03G 15/1615* (2013.01); *G03G 15/04072* (2013.01); *G03G 15/757* (2013.01)

(58) Field of Classification Search

CPC ..... G03G 15/1615; G03G 15/04072; G03G 15/043; G03G 15/757; G03G 15/04036; G03G 15/751; G03G 21/1671; G03G 2215/0158

See application file for complete search history.

(56) References Cited

U.S. PATENT DOCUMENTS 4,816,844 A * 3/1989 Uchida ..... G06K 15/1295 346/145
5,072,244 A * 12/1991 Aoki ..... H04N 1/047 347/116
8,073,378 B2 * 12/2011 Calamita ..... G03G 15/75 347/116

FOREIGN PATENT DOCUMENTS

JP H08-146317 A 6/1996
JP 2000-098685 A 4/2000

* cited by examiner

*Primary Examiner* — Sandra Brase
(74) *Attorney, Agent, or Firm* — Studebaker & Brackett PC

(57) ABSTRACT

An image forming apparatus includes a groove, an exposure device and an adjustment member. In the groove, an end portion of a rotation shaft of a photosensitive drum is inserted. The exposure device is configured to emit a laser light on the photosensitive drum to form an electrostatic latent image. The adjustment member is configured to shift the end portion of the rotation shaft in a direction other than a vertical direction in the groove to adjust a skew of the laser light.

6 Claims, 17 Drawing Sheets

IMAGE FORMING APPARATUS INCLUDING EXPOSURE DEVICE WHICH FORMS ELECTROSTATIC LATENT IMAGE ON PHOTOSENSITIVE DRUM

INCORPORATION BY REFERENCE

This application is based on and claims the benefit of priority from Japanese Patent application No. 2018-034890 filed on Feb. 28, 2018, which is incorporated by reference in its entirety.

BACKGROUND

The present disclosure relates to an image forming apparatus provided with a photosensitive drum on which an electrostatic latent image is formed.

In an electrophotographic type image forming apparatus, a photosensitive drum is exposed with laser light emitted from an optical element of an exposure device to form an electrostatic latent image on the photosensitive drum. If the exposure device is slightly displaced from the photosensitive drum, a skew (a distortion) occurs on the image (the electrostatic latent image) on the photosensitive drum. This causes a color shift. Because plural elements are conventionally arranged between the optical element and the photosensitive drum, it is difficult to position the optical element and the photosensitive drum with a high precision.

For example, the image forming apparatus is sometimes provided with an exposure device arranged obliquely with respect to a rotation shaft of the photosensitive drum. In the image forming apparatus, a rotation speed of the photosensitive drum is finely adjusted such that an inclination of the toner image is the same as the inclination of the exposure device. Alternatively, another image forming apparatus is provided with an exposure device in which a mirror is finely adjusted by using a stepping motor.

However, in a case where the optical element of the exposure device is finely adjusted, the structure and the control process of the exposure device may be complicated and the exposure device may be made large in size.

SUMMARY

In accordance with an aspect of the present disclosure, an image forming apparatus includes a groove, an exposure device and an adjustment member. In the groove, an end portion of a rotation shaft of a photosensitive drum is inserted. The exposure device is configured to emit a laser light on the photosensitive drum to form an electrostatic latent image. The adjustment member is configured to shift the end portion of the rotation shaft in a direction other than a vertical direction in the groove to adjust a skew of the laser light.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus according to one embodiment of the present disclosure will be described.

Figure 1:
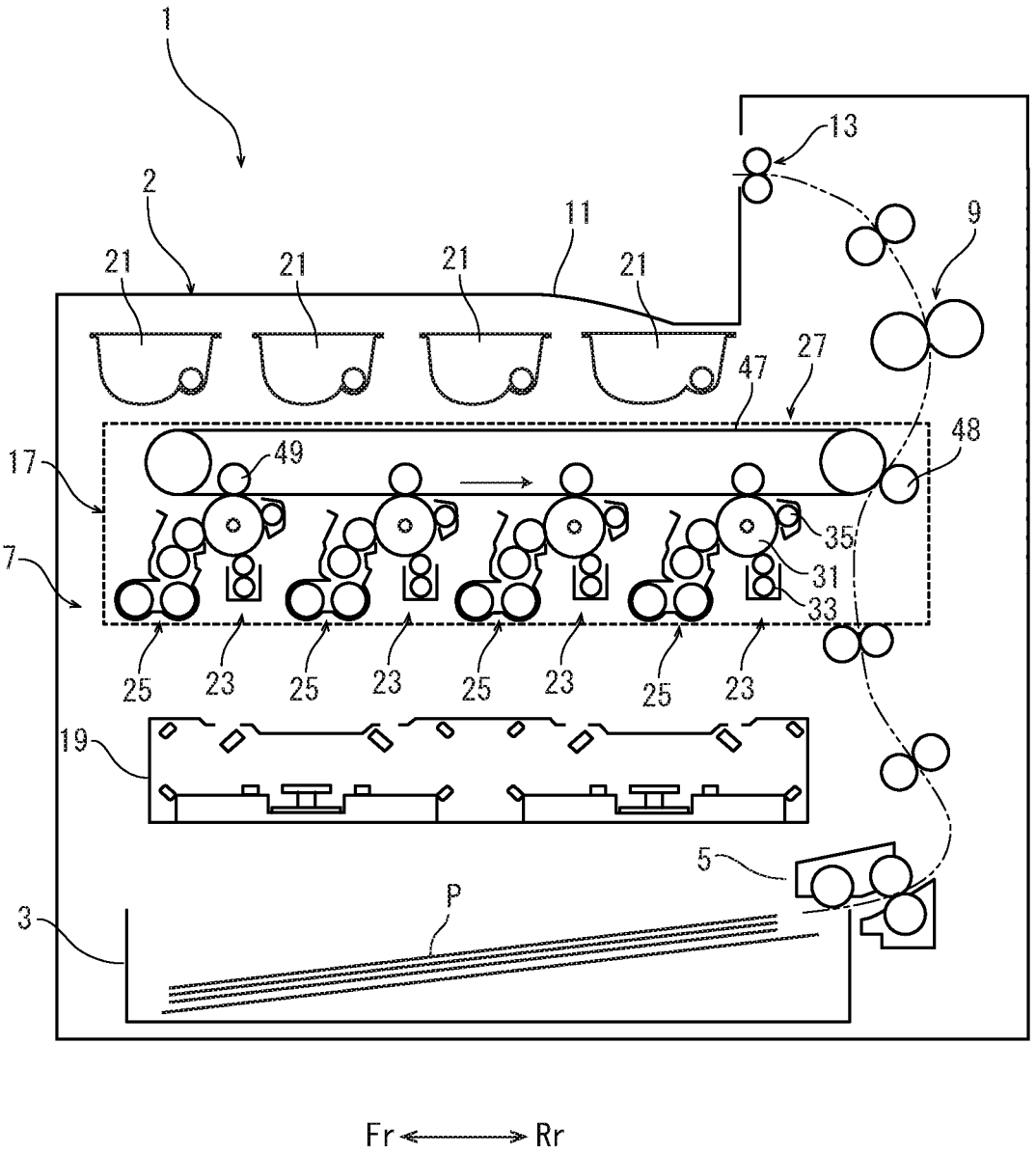
FIG. 1 is a sectional view schematically showing an inner structure of a color printer according to one embodiment of the present disclosure.

First, with reference to FIG. 1, an entire structure of a color printer 1 as the image forming apparatus will be described. FIG. 1 is a front view schematically showing an inner structure of the color printer. In the following description, a left side of FIG. 1 is defined to be a front side of the color printer 1. In each figure, Fr, Rr, L, R, U and Lo respectively indicate a front side, a rear side, a left side, a right side, an upper side and a lower side of the color printer 1.

An apparatus main body 2 of the color printer 1 includes a sheet feeding cassette 3 storing a sheet P, a sheet feeding device 5 feeding the sheet P from the sheet feeding cassette 3, an image forming part 7 forming a full color toner image on the sheet P, a fixing device 9 fixing the toner image on the sheet P, and a sheet ejecting device 13 ejecting the sheet P, having a fixed toner image, on an ejected sheet tray 11. In the apparatus main body 2, a conveying path for the sheet P is formed from the sheet feeding device 5 to the sheet ejecting device 13 through the image forming part 7 and the fixing device 9.

The image forming part 7 is provided with an image forming unit 17, an exposure device 19 arranged below the image forming unit 17 and four toner containers 21 arranged above the image forming unit 17.

Figure 2:
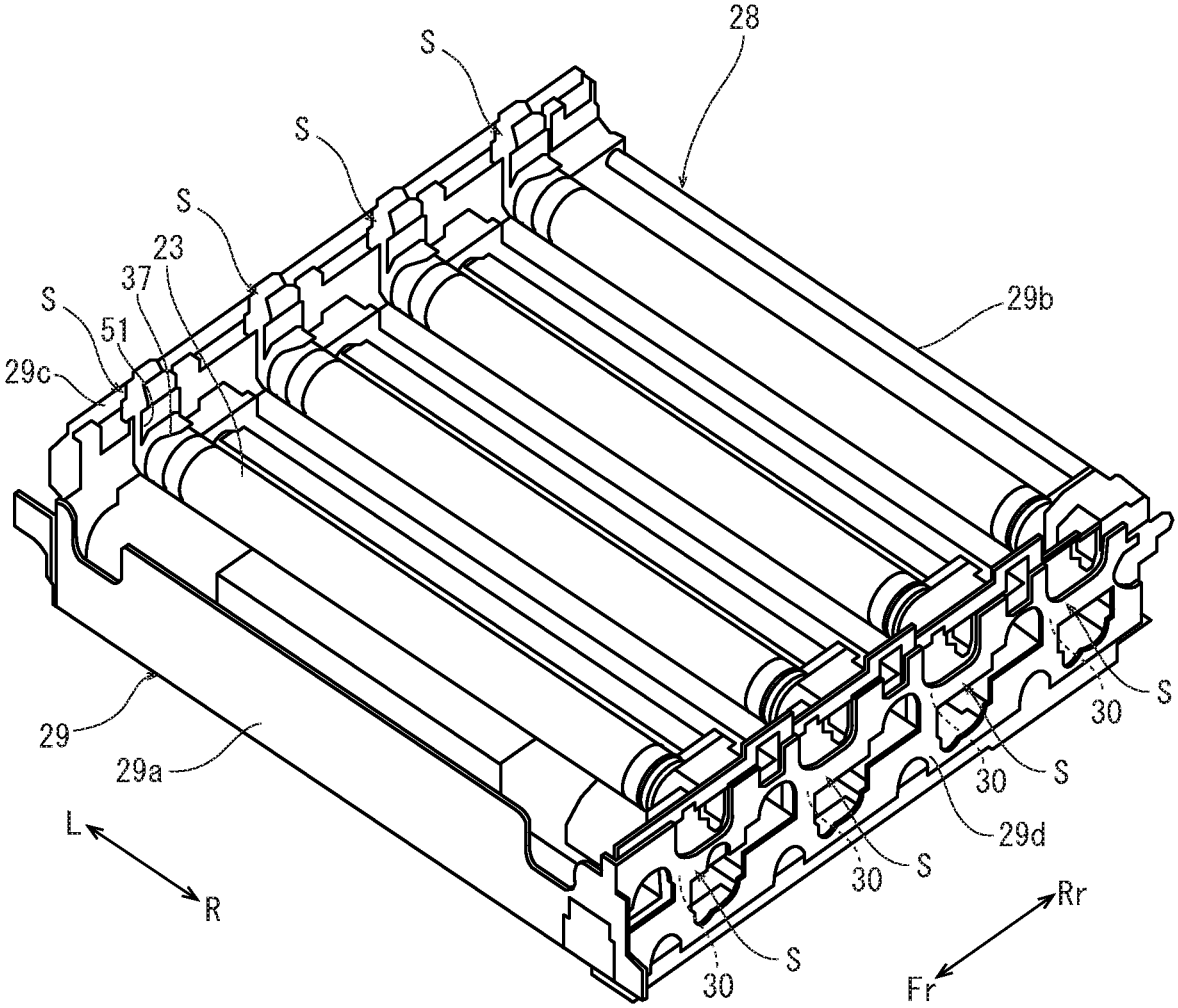
FIG. 2 is a perspective view showing an image forming frame to which a drum unit is attached, in the color printer according to the embodiment of the present disclosure.

Next, with reference to FIG. 1 and FIG. 2, the image forming unit 17 will be described. FIG. 2 is a perspective view showing an image forming frame to which a drum unit and a development unit are attached.

The image forming unit 17 includes four drum units 23, four development units 25, an intermediate transferring unit 27 and an image forming frame 28 (refer to FIG. 2) to which the drum units 23 and the development units 25 are supported. The four drum units 23 and the four development units 25 correspond to four colors (yellow, magenta, cyan and black) of toners (developers).

Figure 3:
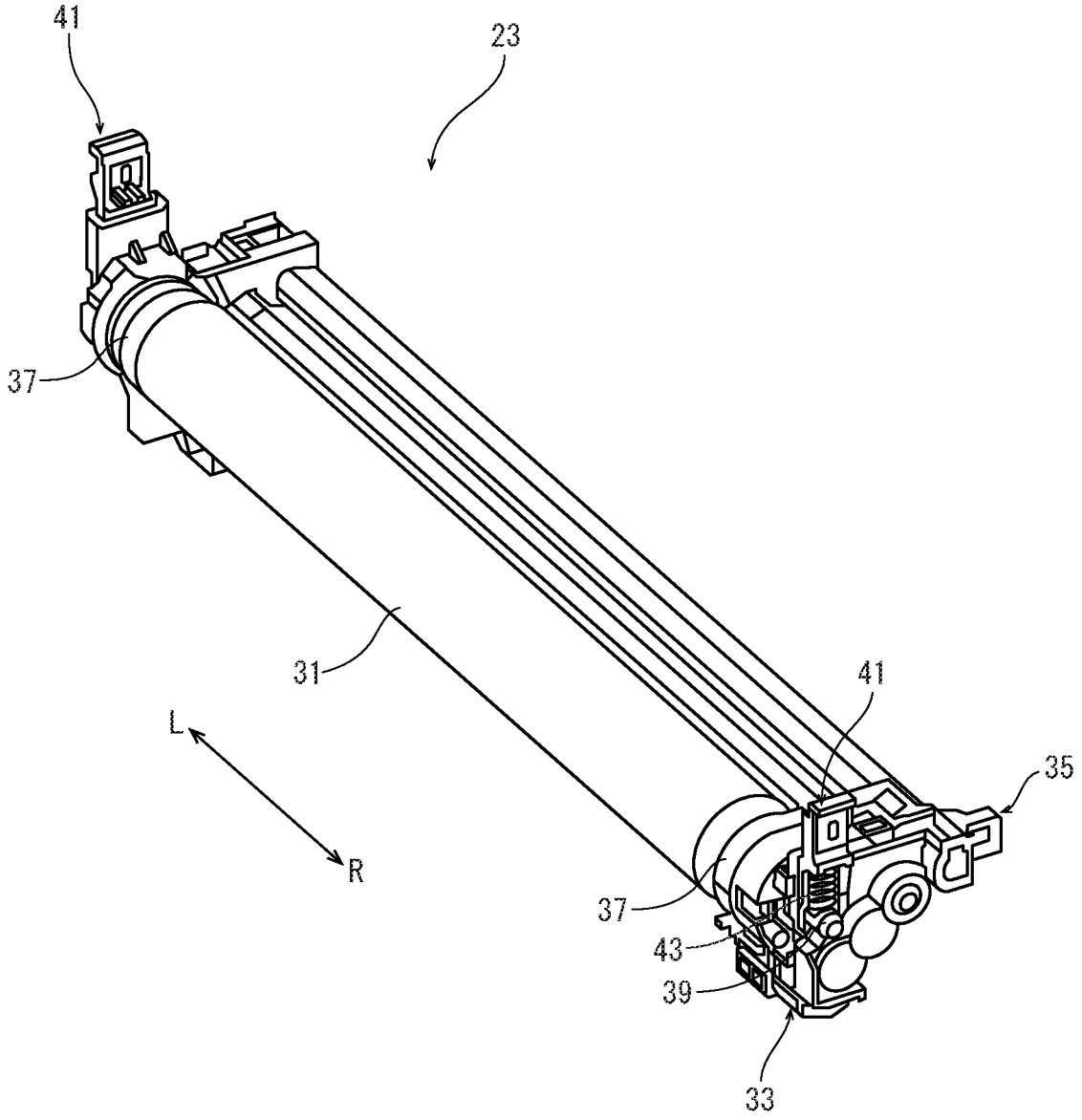
FIG. 3 is a perspective view showing the drum unit, in the color printer according to the embodiment of the present disclosure.

Next, with reference to FIG. 3, the drum unit 23 will be described. FIG. 3 is a perspective view showing the drum unit 23.

The drum unit 23 includes a photosensitive drum 31 on which an electrostatic latent image is formed. To both end openings of the photosensitive drum 31, flange members 37 are fixed. Between the flange members 37, a rotation shaft 39 is penetrated along an axial center of the photosensitive drum 31, and the photosensitive drum 31 is rotated around the rotation shaft 39. The left flange member 37 and a right end portion of the rotation shaft 39 are each inserted in a pressing lever 41. Between the left pressing lever 41 and the left flange member 37 and between the right pressing lever 41 and the right end portion of the rotation shaft 39, respective springs 43 are interposed. The spring 43 is a biasing member which biases each of the left flange member 37 and the right end portion of the rotation shaft 39 downward.

The drum unit 23 further includes a charge device 33 charging the photosensitive drum 31 and a cleaning device removing the toner remaining on the surface of the photosensitive drum 31. The charge device 33 and the cleaning device 35 are arranged along the rotation direction (the clockwise direction in FIG. 1) of the photosensitive drum 31 around an outer circumferential face of the photosensitive drum 31.

With reference to FIG. 1 again, the development unit includes a development device which develops the electrostatic latent image formed on the surface of the photosensitive drum 31 into a toner image with the toner. The development unit 25 is arranged between the charge device 33 and the cleaning device 35 in the rotation direction of the photosensitive drum 31.

The intermediate transferring unit 27 includes an endless intermediate transferring belt 47 and four primary transferring rollers 49 disposed in a hollow space of the intermediate transferring belt 47. Each primary transferring roller 49 is arranged between the development unit 25 and the cleaning device 35 of the drum unit 23 along the rotation direction of the photosensitive drum 31, and faces the photosensitive drum 31 via the intermediate transferring belt 47. The apparatus main body 2 is provided with a secondary transferring roller 48 disposed at a rear side of the intermediate transferring unit 27 so as to face the intermediate transferring belt 47.

The four toner containers 21 store the respective toners of the four colors (yellow, magenta, cyan and black). The toners are supplied from the four toner containers 21 to the respective development units 25.

The exposure device 19 emits laser light toward the photosensitive drum 31 of each drum unit 23. An angle of incidence of the laser light with respect to a tangential direction T on the surface of the photosensitive drum 31 is zero, as described later with reference to FIG. 15. An irradiation angle of the laser light with respect to a vertical line passing through the axial center of the photosensitive drum 31 is about 10 degrees.

Next, an image forming operation will be described. In the image forming part 7, the photosensitive drum 31 of each drum unit 23 is charged by the charge device 33 and then exposed by the exposure device 19 according to an image date to form the electrostatic latent image on the photosensitive drum 31. The electrostatic latent image is developed to the toner image by the development device of each development unit 25. Each toner image is transferred from the photosensitive drum 31 to the intermediate transferring belt 47 by the primary transferring roller 49 of the intermediate transferring unit 27. Thereby, a full color toner image is formed on the intermediate transferring belt 47. The full color toner image is transferred from the intermediate transferring belt 47 to the sheet P by the secondary transferring roller 48. The toner remaining on the photosensitive drum 31 is removed by the cleaning device 35 of the drum unit 23. The sheet P on which the full color toner image is transferred is conveyed to the fixing device 9. The fixing device 9 fixes the full color toner image on the sheet P. The sheet P on which the full color toner image is fixed is ejected to the ejected sheet tray 11 by the sheet ejecting device 13.

Next, the image forming frame 28 will be described with reference to FIG. 2 again. The image forming frame 28 includes a rectangular cylindrical main frame 29 and an adjustment mechanism 30 provided for each drum unit 23.

The main frame 29 includes a front side plate **29*a* and a rear side plate 29*b* which face each other in the front-and-rear direction and a left side plate 29*c* and a right side plate 29*d* which face each other in the left-and-right direction. Between the left side plate 29*c* and the right side plate 29*d*, four attachment sections S to which the four drum units 23 and the four development units 25 are attached are formed in parallel along the front-and-rear direction. The four attachment sections S correspond to yellow, magenta, cyan and black in the order from the front side to the rear side of the main frame 29**.

In each attachment section S of the left side plate **29*c*, a flange receiving groove 51 is formed. The flange receiving groove 51 is cut out from an upper edge of the left side plate 29*c* downward. Into the flange receiving groove 51, the left flange member 37 of the photosensitive drum 31 of each drum unit 23** is inserted.

Figure 4:
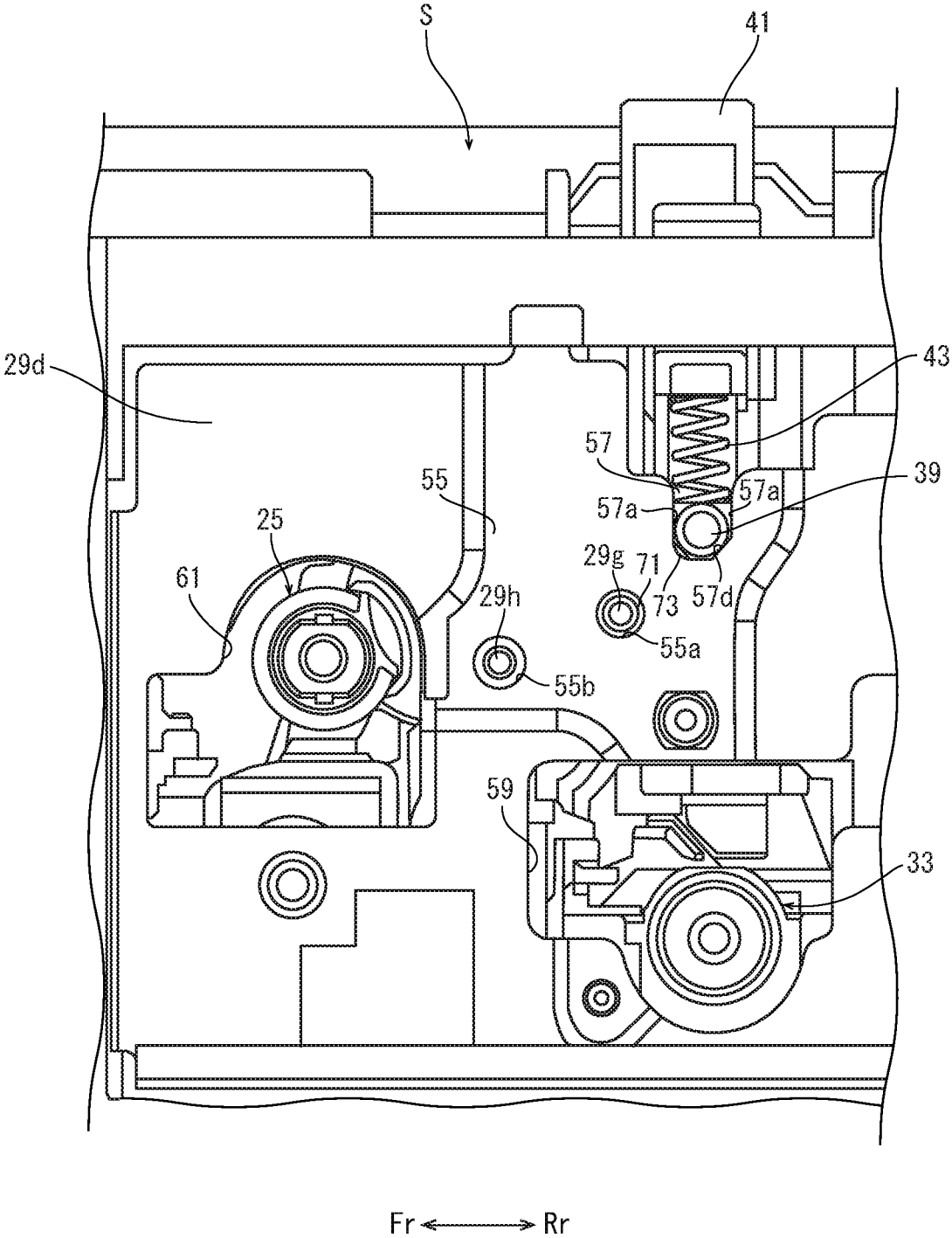
FIG. 4 is a front view showing an attachment section of a right side plate, in the color printer according to the embodiment of the present disclosure.

Each attachment section S of the right side plate **29*d* will be described with reference to FIG. 4 and FIG. 6. FIG. 4 is a front view showing the attachment section, FIG. 5 is a perspective view showing the attachment section and FIG. 6** is a front view showing a groove.

Figure 5:
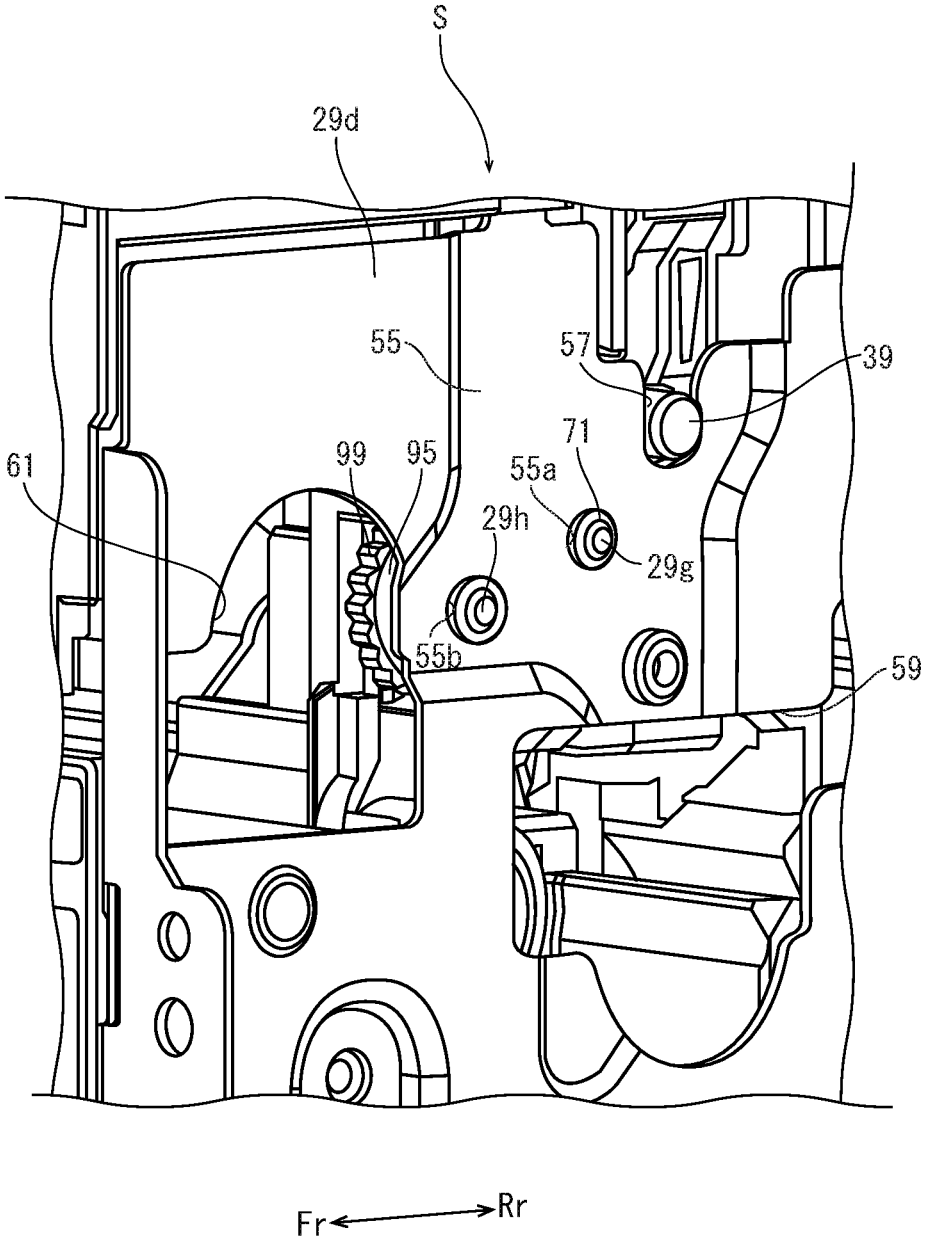
FIG. 5 is a perspective view showing the attachment section of the right side plate, in the color printer according to the embodiment of the present disclosure.

As shown in FIG. 4 and FIG. 5, in each attachment section S, a hollow portion 55 recessed from an outside to an inside is formed. In the hollow portion 55, a groove 57 is formed. The groove 57 is cut out from an upper edge of the right side plate 29*d* downward. Into the groove 57, the right end portion of the rotation shaft 39 of the photosensitive drum 31 is inserted.

Figure 6:
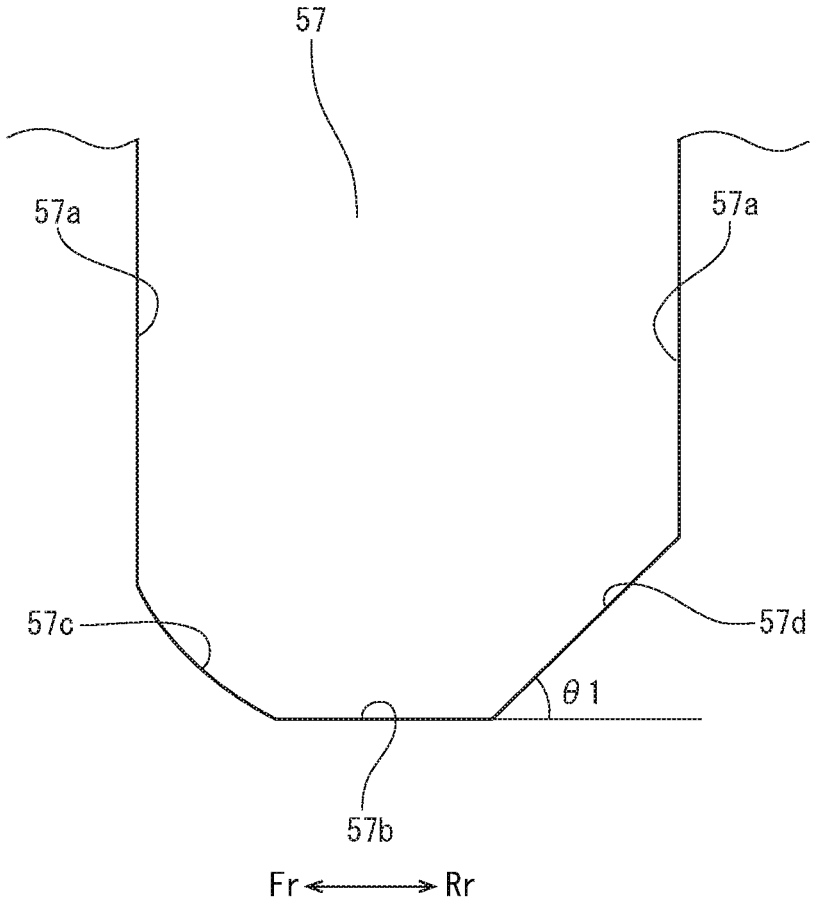
FIG. 6 is a front view showing a groove, in the color printer according to the embodiment of the present disclosure.

With reference to FIG. 6, the groove 57 will be described. The groove 57 has a width slightly wider than a diameter of the rotation shaft 39 of the photosensitive drum 31 considering backlash between the rotation shaft 39 and the groove 57. The groove 57 has vertical front and rear side edges 57*a* and a horizontal bottom edge 57*b*. A lower end portion 57*c* of the front side edge 57*a* is curved downward in an arc-shape to the bottom edge 57*b*. At a corner between the rear side edge 57*a* and the bottom edge 57*b*, a linear inclined part 57*d* is formed. An inclination angle θ1 of the linear inclined part 57*d* with respect to the bottom edge 57*b* (the horizontal direction) is 45 degrees. Corners between the upper edge of the right side plate 29*d*, and the front and rear side edges 57*a* are chamfered As shown in FIG. 4 and FIG. 5, in each attachment section S, a lower opening 59 and a side opening 61 are formed at a lower position and an oblique front lower position of the groove 57, respectively. When the drum unit 23 and the development unit 25 are attached to the attachment section S, the charge device 33 of the drum unit 23 and the development device of the development unit 25 are respectively exposed through the lower opening 59 and the side opening 61. Both the openings 59 and 61 are communicated with the hollow portion 55. In the hollow portion 55, a first through hole 55*a* and a second through hole 55*b* are formed between the groove 57 and the side opening 61.

Figure 7:
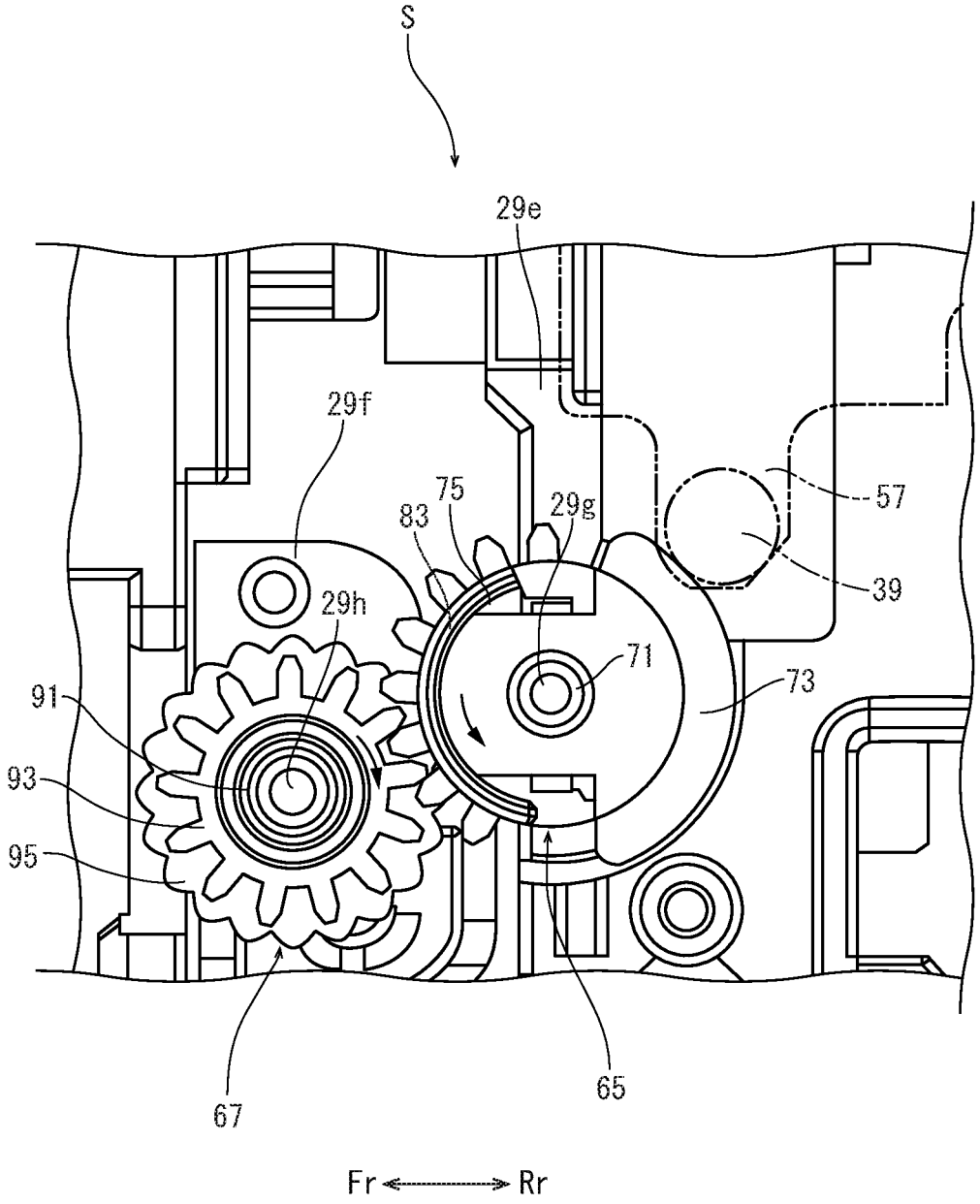
FIG. 7 is a front view showing an adjustment mechanism, in the color printer according to the embodiment of the present disclosure.

Next, the adjustment mechanism 30 will be described with reference to FIG. 7 to FIG. 9. FIG. 7 is a front view showing the adjustment mechanism, FIG. 8 is a sectional view showing the adjustment mechanism and FIG. 9 is a front view showing a first inner plate and a second inner plate.

Figure 8:
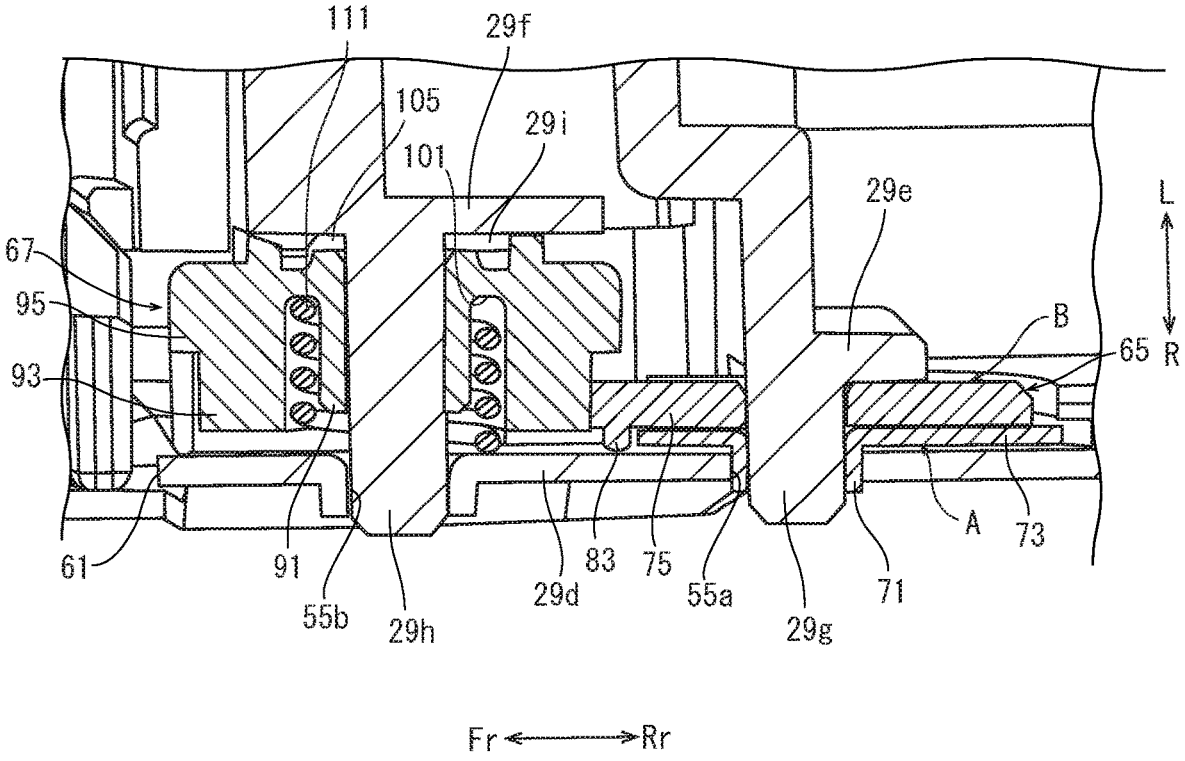
FIG. 8 is a sectional view showing the adjustment mechanism, in the color printer according to the embodiment of the present disclosure.

The adjustment mechanism 30 includes an adjustment plate 65 and a dial gear 67 as shown in FIG. 7 and FIG. 8. The adjustment plate 65 is an adjustment member shifting the right end portion of the rotation shaft 39 of the photosensitive drum 31. The dial gear 67 is a dial rotating the adjustment plate 65.

The adjustment plate 65 is supported in a rotatable manner between the right side plate 29*d* and a first inner plate 29*e* disposed inside the right side plate 29*d*. The dial gear 67 is supported in a rotatable manner between the right side plate 29*d* and a second inner plate 29*f* disposed inside the right side plate 29*d*.

Figure 9:
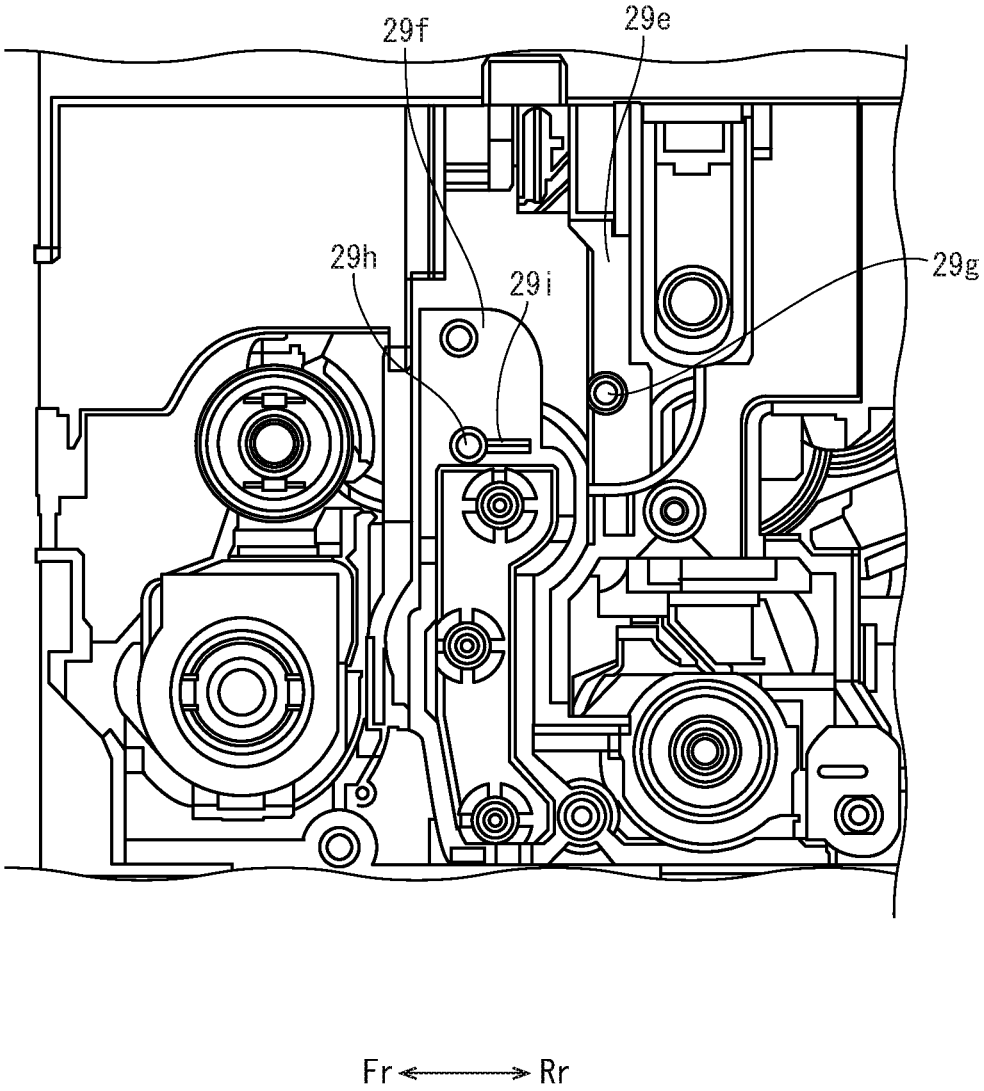
FIG. 9 is a front view showing a first inner plate and a second inner plate, in the color printer according to the embodiment of the present disclosure.

As shown in FIG. 9, the first inner plate 29*e* is provided with a first shaft 29*g* protruding horizontally rightward. The first shaft 29*g* is inserted in the first through hole 55*a* of the right side plate 29*d* (refer to FIG. 4, FIG. 5 and FIG. 8). The second inner plate 29*f* is provided with a second shaft 29*h* protruding horizontally rightward. The second shaft 29*h* is inserted in the second through hole 55*b* of the right side plate 29*d* (refer to FIG. 4, FIG. 5 and FIG. 8). The second inner plate 29*f* is provided with a protrusion 29*i* extending horizontally from the second shaft 29*h* rearward.

Figure 10:
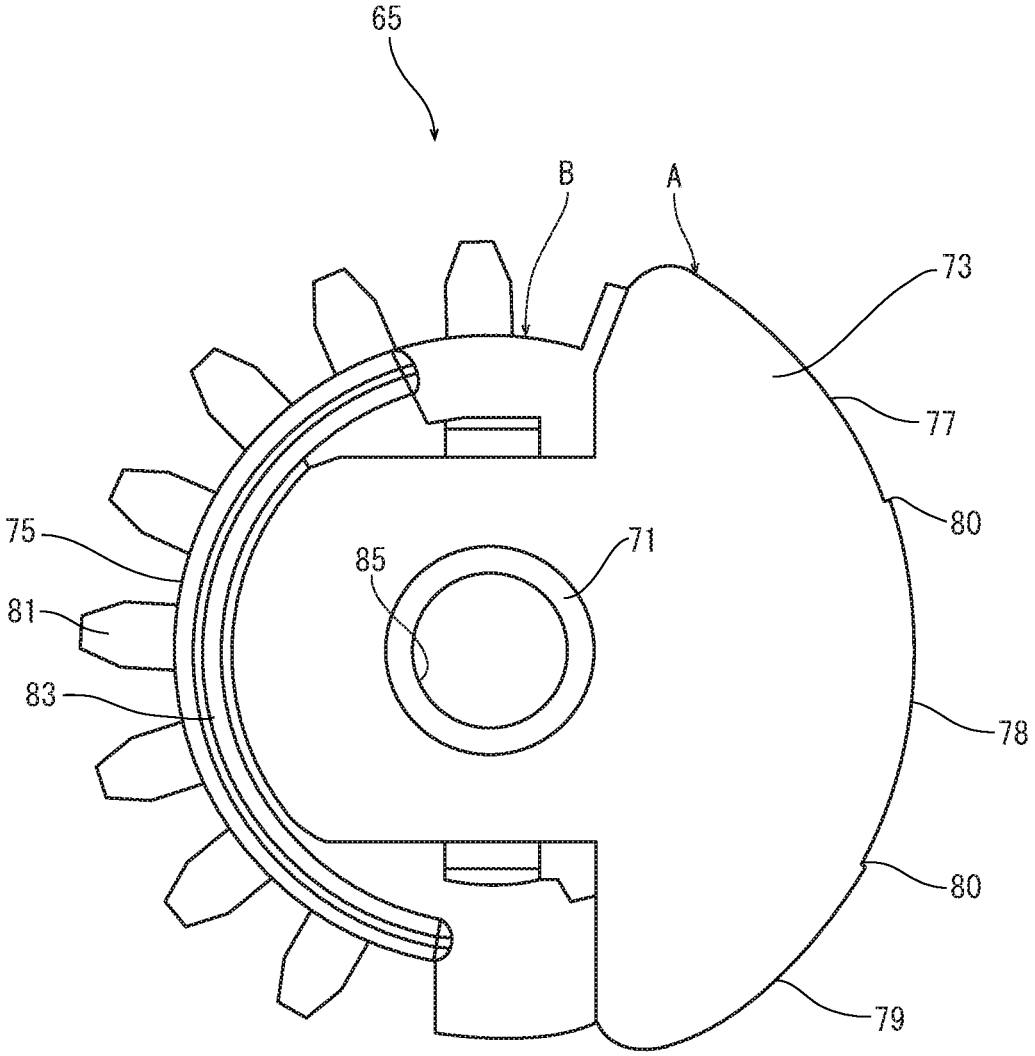
FIG. 10 is a front view showing an adjustment plate, in the color printer according to the embodiment of the present disclosure.

Next, the adjustment plate 65 will be described with reference to FIG. 10. FIG. 10 is a front view showing the adjustment plate.

The adjustment plate 65 is a disk-shaped member, and includes a cylindrical axial hole part 71, an approximately semicircular adjustment part 73 and an approximately semicircular gear part 75. The adjustment part 73 is provided at one side (the rear side) of the axial hole part 71 and the gear part 75 is provided at the other side (the front side) of the axial hole part 71. Around an outer circumferential edge of the adjustment part 73, a first arc-shaped edge 77, a second arc-shaped edge 78 and a third arc-shaped edge 79 are formed in the order in the circumferential direction. The first arc-shaped edge 77, the second arc-shaped edge 78 and the third arc-shaped edge 79 have different radius, and the radius becomes large in a stepwise manner in the order. For example, a difference in the radius between the adjacent arc-shaped edges is 0.1 mm. The adjacent arc-shaped edges are connected via a stepped portion 80 extending radially. Around an outer circumferential edge of the gear part 75, gear teeth 81 are formed at predetermined intervals. On one face of the gear part 75, an arc-shaped rib 83 along the circumferential direction is formed. A tip end face of the rib 83 is formed in a semi-circular cross section.

The adjustment plate 65 is formed by preparing a member A formed with the axial hole part 71 and the adjustment part 73 integrally and a member B formed with the gear part 75 and an axial hole 85 integrally, overlapping them with aligning the axial hole part 71 and the axial hole 85 coaxially and then coupling them, as shown in FIG. 8 and FIG. 10. The member A is made of metal, and the member B is made of resin. However, the configuration of the adjustment plate 65 is not limited thereto.

As shown in FIG. 7 and FIG. 8, the adjustment plate 65 is supported by the first shaft 29*g* of the first inner plate 29*e* with the rib 83 facing the right side plate 29*d*. In detail, the first shaft 29*g* is inserted in the axial hole part 71 of the adjustment plate 65, and the axial hole part 71 is penetrated through the first hole 55*a*. The adjustment plate 65 is supported in a rotatable manner around the first shaft 29*g* and in a non-movable manner in an axis direction of the first shaft 29*g*. When the adjustment plate 65 is rotated, the tip end face of the rib 83 is slid with respect to an inner face of the right side plate 29*d*. As shown in FIG. 7, a part of the outer circumferential edge of the adjustment part 73 is exposed to a lower end portion of the groove 57 obliquely from the front lower side.

Figure 11:
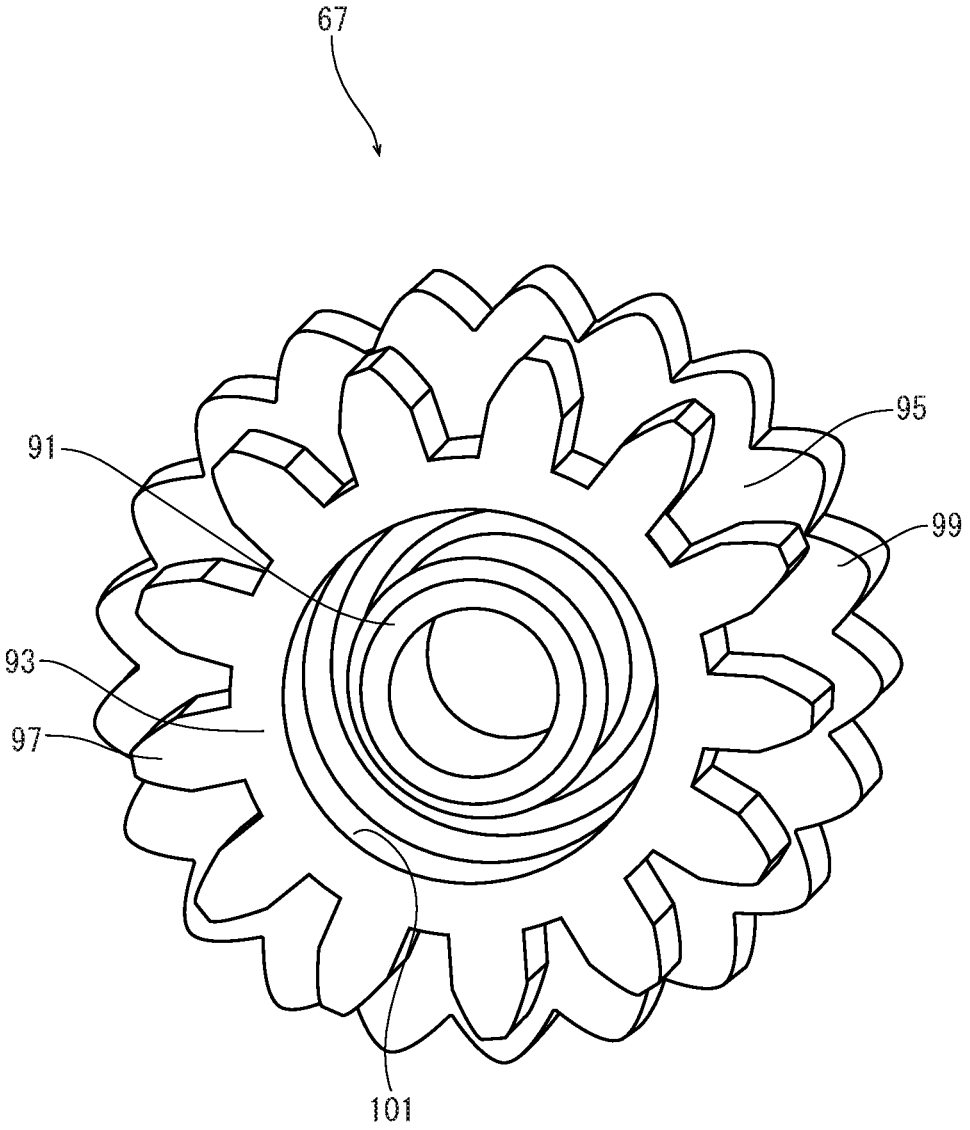
FIG. 11 is a perspective view showing a dial gear, in the color printer according to the embodiment of the present disclosure.
Figure 12A:
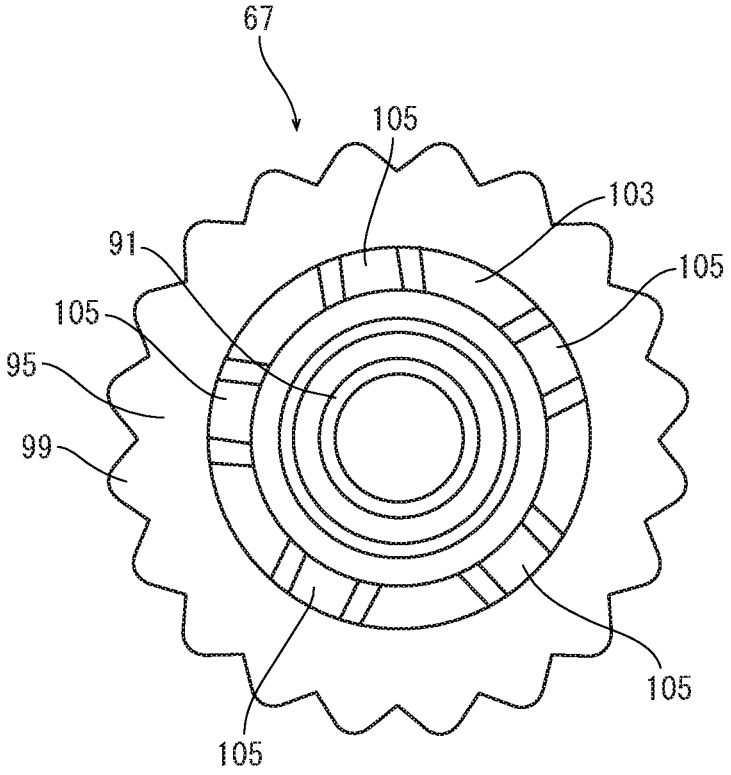
FIG. 12A is a back view showing the dial gear, in the color printer according to the embodiment of the present disclosure.
Figure 12B:
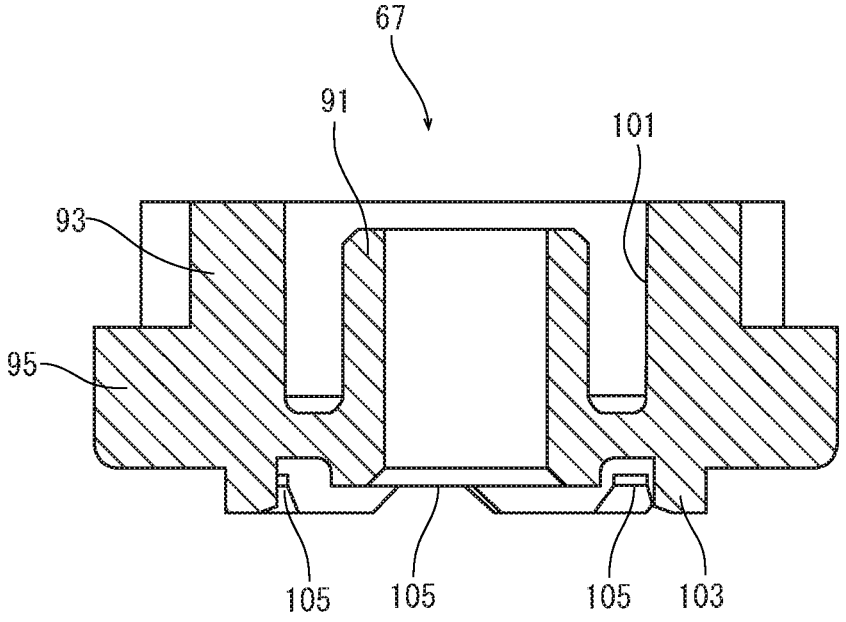
FIG. 12B is a sectional view showing the dial gear, in the color printer according to the embodiment of the present disclosure.

Next, the dial gear 67 will be described with reference to FIG. 11, FIG. 12A and FIG. 12B. FIG. 11 is a perspective view showing the dial gear, FIG. 12A is a back view showing the dial gear and FIG. 11B is a sectional view showing the dial gear.

The dial gear 67 is a disk-shaped member, and includes an axial hole part 91, a gear part 93 and a rack part 95 which are provided coaxially with the axial hole part 91. The rack part 95 has an outer diameter larger than that of the gear part 93. Along an outer circumferential edge of the gear part 93, gear teeth 97 engageable with the gear teeth 81 of the gear part 75 of the adjustment plate 65 are formed. Along an outer circumferential edge of the rack part 95, rack teeth 99 are formed at predetermined intervals.

On one face (a face at the side of the gear part 93) of the dial gear 67, an annular groove 101 is formed around the axial hole part 91. As shown in FIG. 12A and FIG. 12B, on the other face (a face at the side of the rack part 95) of the dial gear 67, an annular rib 103 is formed around the axial hole part 91. The rib 103 has plural (for example, five) recesses 105 arranged along the circumferential direction at equal center angles. Both side faces of each recess 105 are inclined outward in the circumferential direction.

As shown in FIG. 7 and FIG. 8, the axial hole part 91 of the dial gear 67 is inserted to the second shaft 29*h* of the second inner plate 29*f* with the gear part 93 facing the inner face of the right side plate 29*d*. The dial gear 67 is supported in a rotatable manner around the second shaft 29*h* and in a movable manner along an axial direction of the second shaft 29*h*. As shown in FIG. 8, between the groove 101 of the dial gear 67 and the right side plate 29*d*, a spring 111 is arranged. The spring 111 biases the dial gear 67 to the second inner plate 29*f* along the axial direction of the second shaft 29*h*. Thereby, one of the recesses 105 (refer to FIG. 12A and FIG. 12B) of the rib 103 is engaged with the protrusion 29*i* of the second inner plate 29*f* to restrict the dial gear 67 from being rotated. The gear teeth 97 of the gear part 93 is meshed with the gear teeth 81 of the gear part 75 of the adjustment plate 65, and the adjustment plate 65 is engaged with the dial gear 67. As shown in FIG. 5, the rack teeth 99 of the rack part 95 is exposed to the side opening 61 of the right side plate 29*d* when viewed obliquely from the front side.

When the dial gear 67 is rotated in one direction, the adjustment plate 65 is rotated in a counter direction to the rotation direction of the dial gear 67. Then, the outer circumferential edge of the adjustment plate 65 exposed through the lower end portion of the groove 57 is changed. That is, by rotating the dial gear 67, one of the first arc-shaped edge 77, the second arc-shaped edge 78 and the third arc-shaped edge 79 is exposed through the lower end portion of the groove 57.

Additionally, the dial gear 67 is prevented from being rotated with respect to the right side plate 29*d* at a position where one of the first arc-shaped edge 77, the second arc-shaped edge 78 and the third arc-shaped edge 79 is exposed through the lower end portion of the groove 57. In detail, when the dial gear 67 is rotated, one inclined side face of the recess 105 engaged with the protrusion 29*i* comes into contact with the protrusion 29*i*, the inclined side face is guided in a direction away from the protrusion 29*i* against the biasing force of the spring 111, and then the rib 103 runs on the protrusion 29*i*. When the dial gear 67 is further rotated, the dial gear 67 is biased by the spring 111 in a direction close to the protrusion 29*i*, and then the adjacent recess 105 is engaged with the protrusion 29*i*. At this time, a click feeling is offered on the dial gear 67.

When the drum unit 23 is attached to the above described attachment section S, as shown in FIG. 2, the left flange member 37 of the photosensitive drum 31 is inserted in the flange receiving groove 51 of the left side plate 29*c* and, as shown in FIG. 4, the right end portion of the rotation shaft 39 of the photosensitive drum 31 is inserted in the groove 57 of the right side plate 29*d*.

Figure 13:
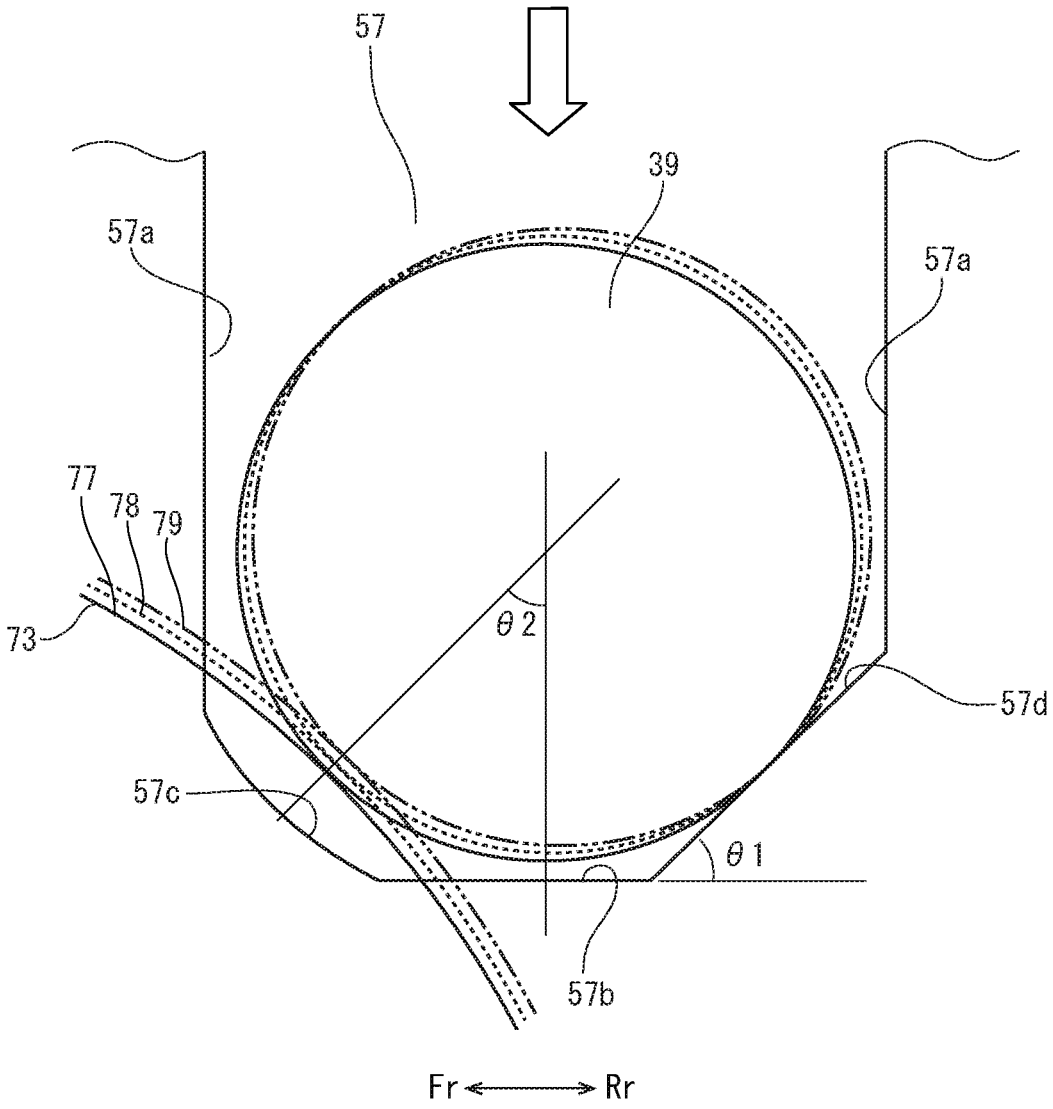
FIG. 13 is a front view explaining a shift of a rotation shaft in a groove, in a skew adjustment way of a first embodiment, in the color printer according to the embodiment of the present disclosure.

With reference to FIG. 13, the rotation shaft 39 inserted in the groove 57 will be described. FIG. 13 is a front view showing the rotation shaft inserted in the groove (the spring 43 is not shown).

As described above, through the lower end portion of the groove 57, the outer circumferential edge (for example, the first arc-shaped edge 77) of the adjustment part 73 of the adjustment plate 65 is exposed obliquely from the front lower side. When the rotation shaft 39 is inserted in the groove 57, the first arc-shaped edge 77 comes into contact with the rotation shaft 39 obliquely from the front lower side and presses the rotation shaft 39 to the inclined part 57*d* of the groove 57. For example, an angle θ2 of a line passing through a contact position of the first arc-shaped edge 77 of the adjustment part 73 with the rotation shaft 39 and the axial center of the rotation shaft 39 with respect to a vertical line passing through the axial center of the rotation shaft 39 is 45 degrees.

Additionally, the pressing lever 41 is engaged with the right side plate 29*d*, and the rotation shaft 39 is biased downward by the spring 43 (refer to a white blank arrow in FIG. 13). Then, the rotation shaft 39 is pressed against the first arc-shaped edge 77 of the adjustment part 73 and the inclined part 57*d* of the groove 57 to be positioned. The rotation shaft 39 does not come into contact with the rear side edge 57*a*.

Next, a skew adjustment way of a first embodiment will be described.

As shown by a solid line in FIG. 13, the right end portion of the rotation shaft 39 is positioned by the outer circumferential edge (the first arc-shaped edge 77 in this example) of the adjustment part 73 of the adjustment plate 65 and the inclined part 57*d* of the groove 57 of the right side plate 29*d*. As shown in FIG. 4 and FIG. 5, a finger is inserted through the side opening 61, catches the rack teeth 99 of the rack part 95 of the dial gear 67 and then rotates the dial gear 67 in the clockwise direction in FIG. 7 until the click feeling is felt. Then, the adjustment plate 65 is rotated in the counterclockwise direction in FIG. 7, the second arc-shaped edge 78 is exposed trough the lower end portion of the groove 57, and then, as shown by a broken line in FIG. 13, the second arc-shaped edge 78 comes into contact with the rotation shaft 39. Because the second arc-shaped edge 78 has a radius larger than that of the first arc-shaped edge 77, the rotation shaft 39 is pushed out outwardly in the radial direction of the adjustment plate 65 and then shifted obliquely upward along the inclined part 57*d*. The inclining angle θ1 of the inclined part 57*d* with respect to the horizontal direction is 45 degrees, and a shift distance along the horizontal direction is the same as a shift distance along the vertical direction.

If the right end portion of the rotation shaft 39 is further shifted upward, the dial gear 67 is further rotated in the clockwise direction in FIG. 7 until the click feeling is felt. Then, the adjustment plate 65 is further rotated in the counterclockwise direction in FIG. 7, the third arc-shaped edge 79 is exposed through the lower end portion of the groove 57, and then, as shown by a two-dotted chain line in FIG. 13, the third arc-shaped edge 79 comes into contact with the rotation shaft 39. Because the third arc-shaped edge 79 has a radius larger than that of the second arc-shaped edge 78, the rotation shaft 39 is pushed out outwardly in the radial direction of the adjustment plate 65 and then shifted obliquely upward along the inclined part 57*d*. Because a difference in the radius between the second and third arc-shaped edges 78 and 79 is equal to a difference in the radius between the first and second arc-shaped edges 77 and 78, the rotation shaft 39 is shifted by the same distance (for example, 0.28 mm) as the distance when the dial gear 67 is rotated the last time. The shift distance along the horizontal direction is the same as the shift distance along the vertical direction.

When the rotation shaft 39 is shifted downward, the dial gear 67 is rotated in the counterclockwise direction in FIG. 7. When the dial gear 67 is rotated until the click feeling is felt, the adjustment plate 65 is rotated in the clockwise direction in FIG. 7, and the second arc-shaped edge 78 comes into contact with the rotation shaft 39 as shown in FIG. 13. Because the second arc-shaped edge 78 has a radius smaller than that of the third arc-shaped edge 79, the rotation shaft 39 is shifted downward along the inclined part 57*d*.

As described above, when the dial gear 67 is operated to rotate the adjustment plate 65, the contact position of the outer circumferential edge of the adjustment part 73 of the adjustment plate 65 with the rotation shaft 39 is varied. Then, depending on the radius of the adjustment part 73 at the contact position, the rotation shaft 39 is shifted obliquely along the inclined part 57*d* so that it becomes possible to shift the right end portion of the rotation shaft 39 of the photosensitive drum 39 obliquely. In the embodiment, because the difference in the radius between the adjacent arc-shaped edges is constant, the rotation shaft 39 is shifted obliquely by the same distance. Additionally, because the inclining angle θ1 of the inclined part 57*d* with respect to the horizontal direction is 45 degrees, the shift distance along the horizontal direction is the same as the shift distance along the vertical direction.

Figure 14A:
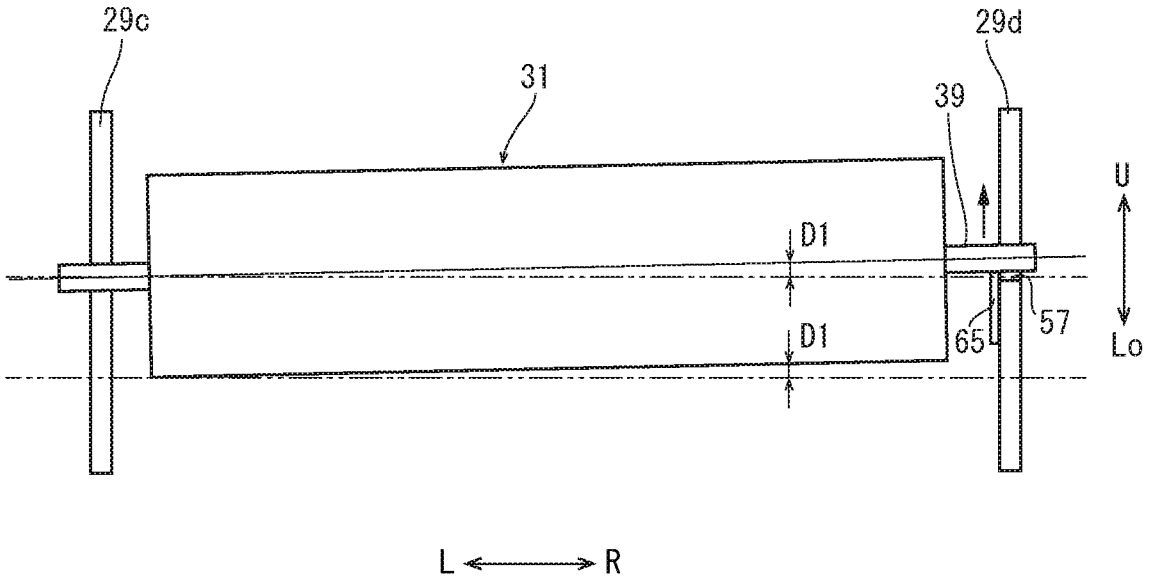
FIG. 14A is a side view showing an inclined photosensitive drum, in the color printer according to the embodiment of the present disclosure.
Figure 14B:
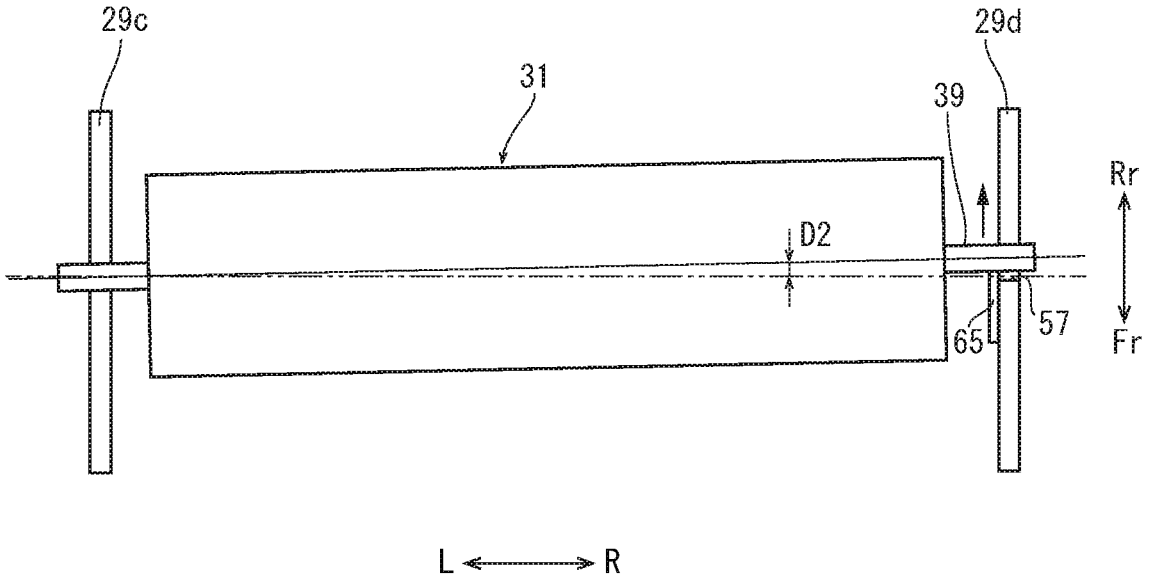
FIG. 14B is a plan view showing the inclined photosensitive drum, in the color printer according to the embodiment of the present disclosure.

When the right end portion of the rotation shaft 39 of the photosensitive drum 31 is shifted obliquely, the photosensitive drum 31 is inclined upward in the right direction as shown in FIG. 14A and inclined rearward as shown in FIG. 14B. FIG. 14A is a side view showing the inclined photosensitive drum and FIG. 14B is a plan view showing the inclined photosensitive drum. Then, a vertical shift distance D1 and a horizontal shift distance D2 of the right end portion of the rotation shaft 39 become gradually larger from the left side to the right side in the axial direction of the rotation shaft 39, and a writing position of the laser light on the photosensitive drum 31 is displaced in the circumferential direction of the photosensitive drum 31.

Figure 15:
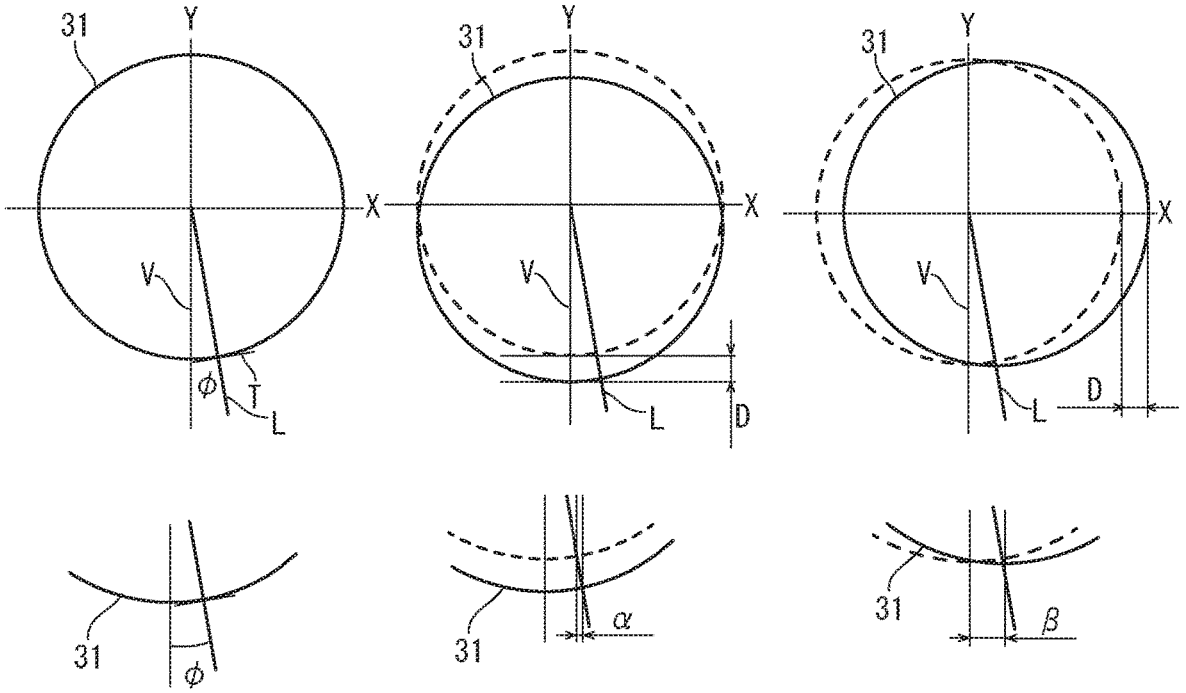
FIG. 15 is a view schematically explaining a writing position displacement of laser light, in the color printer according to the embodiment of the present disclosure.

Next, with reference to FIG. 15, the displacement of the writing position of the laser light emitted from the exposure device 19 will be described. FIG. 15 is views explaining the displacement of the writing position of the laser light in a case where the photosensitive drum 31 is shifted in a direction (a Y direction) along the vertical line V passing through the axial center of the photosensitive drum 31 (the axial center of the rotation shaft 39) and in another case where the photosensitive drum 31 is shifted in the horizontal direction (a X direction) perpendicular to the Y direction. An angle of incidence of the laser light L on the surface of the photosensitive drum 31 is zero (perpendicularly with respect to a tangential line T on the surface of the photosensitive drum 31), and an angle φ of the laser light L with respect to the vertical line V passing through the axial center of the photosensitive drum 31 is about 10 degrees.

As shown in the center figure in FIG. 15, in the case where the photosensitive drum 31 is shifted in the Y direction by a shift distance D, a displacement distance of the writing position of the laser light along the circumferential direction of the photosensitive drum 31 is set to be α. As the angle φ becomes small, the displacement distance α becomes small. On the other hand, as shown in the right figure in FIG. 15, in the case where the photosensitive drum 31 is shifted in the X direction by the same shift distance D, a displacement distance of the writing position of the laser light along the circumferential direction of the photosensitive drum 31 is set to be β. As shown in FIG. 15, the displacement distance β is larger than the displacement distance α. Additionally, the displacement distance becomes large as the shift distance D of the photosensitive drum 31 becomes large.

As described above, because the shift distances D1 and D2 become large from the left side to the right side along the axial direction of the rotation shaft 39, the displacement distance α of the writing position becomes large from the left side to the right side. As a result, the writing position is displaced obliquely with respect to the axial direction of the rotation shaft 39 so that a skew can be adjusted.

Like the exposure device 19 of the present embodiment, in a case where the laser light is incident from the approximately lower side along the vertical direction (the Y direction), the amount of the displacement distance of the writing position responds to the shift distance of the rotation shaft 39 in the X direction more sensitively than in the Y direction. In other words, a ratio (an adjustment sensitivity) of the amount of the displacement distance of the writing position to the amount of the shift distance of the rotation shaft 39 is smaller in the Y direction than in the X direction. Conventionally, the low adjustment sensitively makes a fine adjustment easy. On the other hand, when the skew is remarkably large and it is required to shift the photosensitive drum 31 largely, the high adjustment sensitivity is preferable.

In a case of the angle φ of 45 degrees, the amount of the displacement distance of the writing position is equal between when the rotation shaft 39 is shifted in the X direction and when the rotation shaft 39 is shifted in the Y direction. In a case of the angle φ of 0 degree, the writing position is not displaced even if the rotation shaft 39 is shifted in the Y direction. Accordingly, the angle φ is set to be larger than 0 degree and 45 degrees or smaller.

As described above, in the color printer 1 of the present disclosure, by shifting the right end portion of the rotation shaft 39 of the photosensitive drum 31 obliquely using the adjustment mechanism 30, it becomes possible to displace the writing position of the laser light on the photosensitive drum 31. Accordingly, it becomes possible to displace the writing position and to adjust the skew of the laser light with respect to the axial direction of the photosensitive drum 31. That is, the skew can be corrected not on the side of the exposure device 19 but on the side of the photosensitive drum 31 so that a complicated work, such as a fine adjustment of the optical component of the exposure device, can be eliminated. In the present embodiment, by shifting the right end portion of the rotation shaft 39 obliquely, it becomes possible to correct the skew with a middle adjustment sensitivity.

Figure 16:
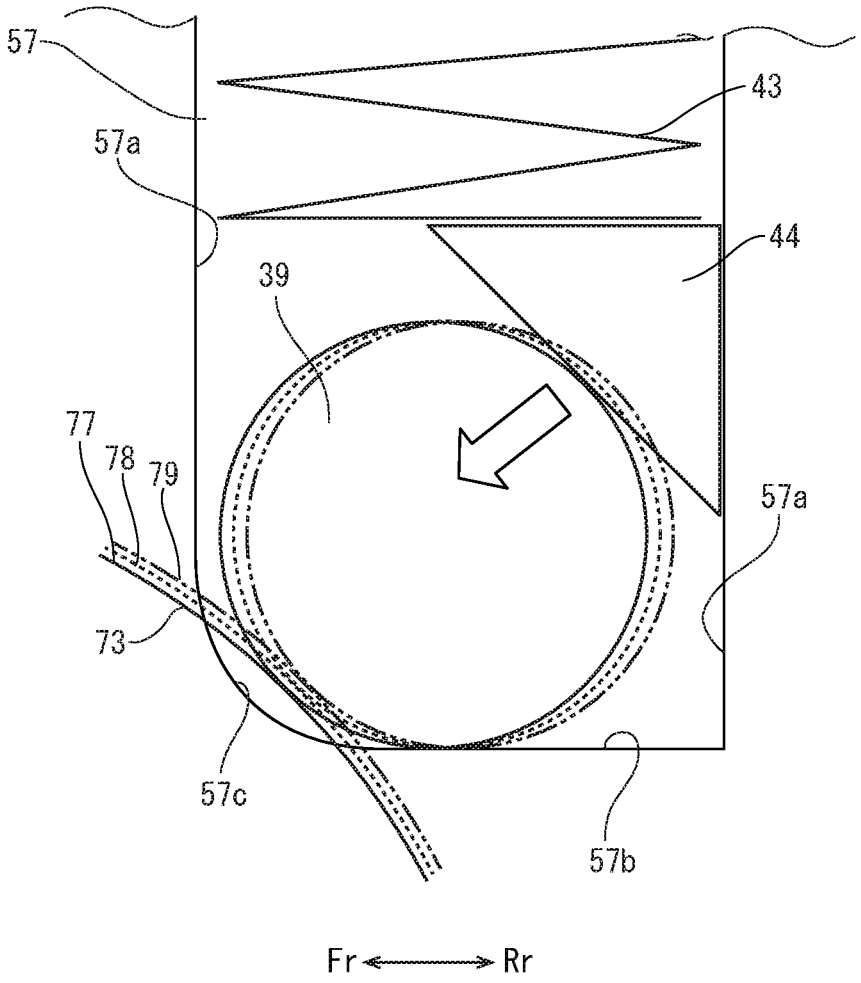
FIG. 16 is a front view showing the groove and the rotation shaft, in the skew adjustment way of a second embodiment, in the color printer according to the embodiment of the present disclosure.

Next, a skew adjustment way of a second embodiment will be described with reference to FIG. 16. FIG. 16 is a front view showing the groove. In the second embodiment, the right end portion of the rotation shaft 39 is shifted horizontally.

First, a shape of the groove 57 will be described. The groove 57 has a width wider than the diameter of the rotation shaft 39. In detail, the width of the groove 57 is wider than the width of the groove 57 of the first embodiment, and a difference between the width of the groove 57 and the diameter of the rotation shaft 39 is considerably larger than the backlash between the rotation shaft 39 and the groove 57. As shown in FIG. 16, the groove 57 has vertical front and rear side edges 57*a* and a horizontal bottom edge 57*b* as a linear horizontal part. A lower end portion 57*c* of the front side edge 57*a* is curved in an arc-shape to the bottom edge 57*b*.

In the same way as the first embodiment, a part of the outer circumferential edge (the first arc-shaped edge 77, for example) of the adjustment part 73 of the adjustment plate 65 is exposed through the lower end portion of the groove 57 obliquely from the front lower side.

In the second embodiment, the right end portion of the rotation shaft 39 of the photosensitive drum 31 is inserted into the groove 57 and comes into contact with the bottom edge 57*b*. Additionally, the pressing lever 41 is engaged with the right side plate 29*d*, and the right end portion of the rotation shaft 39 is biased downward by the spring 43. A wedge member 44 is arranged between the spring 43 and the rotation shaft 39, and inverts the downward biasing direction of the spring 43 into an oblique front lower direction. Then, the right end portion of the rotation shaft 39 is biased in the oblique front lower direction, that is, to the outer circumferential edge (the first arc-shaped edge 77) of the adjustment part 73 of the adjustment plate 65, as shown in a white blank arrow in FIG. 16.

As described above, the right end portion of the rotation shaft 39 is pressed against the bottom edge 57*b* and the outer circumferential edge (the first arc-shaped edge 77) by the spring 43, and positioned by the bottom edge 57*b*, the outer circumferential edge (the first arc-shaped edge 77) and the spring 43 (the wedge member 44).

When the rotation shaft 39 is shifted, the dial gear 67 is operated such that the adjustment plate 65 is rotated in a direction where the radius of the adjustment part 73 becomes larger. Then, as shown by a broken line and a two-dotted chain line in FIG. 16, the rotation shaft 39 is shifted rearward along the bottom edge 57*b* while being pressed by the spring 43. That is, the rotation shaft 39 is shifted rearward horizontally.

As described above, in the second embodiment, the right end portion of the rotation shaft 39 of the photosensitive drum 31 is shifted horizontally, that is, in the X direction in FIG. 15. Then, as described above with reference to FIG. 15, in a case where the laser light is incident from approximately the lower side along the vertical direction (the Y direction), the ratio (the adjustment sensitivity) of the amount of the displacement distance of the writing position to the amount of the shift distance of the rotation shaft 39 becomes large. Accordingly, if the skew is large and it is required to shift the photosensitive drum 31 for a large distance, it becomes possible to perform the skew adjustment work effectively.

Figure 17:
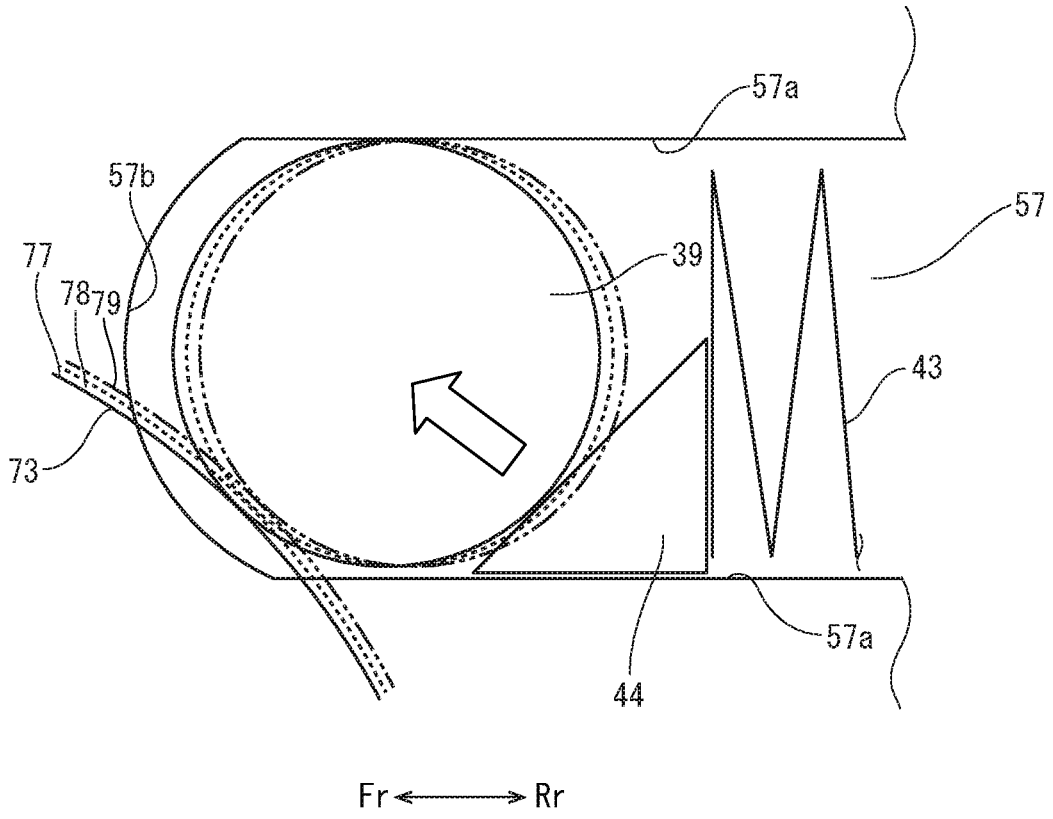
FIG. 17 is a front view showing the groove and the rotation shaft, in the skew adjustment way of a third embodiment, in the color printer according to the embodiment of the present disclosure.

Next, a skew adjustment way of a third embodiment will be described with reference to FIG. 17. FIG. 17 is a front view showing the groove. In the third embodiment also, the right end portion of the rotation shaft 39 is shifted horizontally. The third embodiment is applied to the image forming apparatus where the drum unit 23 and the development unit 25 are arranged in parallel along the upper-and-lower direction. In this case, the drum unit 23 and the development unit 25 are attached and detached along the horizontal direction.

First, a shape of the groove 57 will be described. The groove 57 has horizontal upper and lower side edges 57*a* as a linear horizontal part and an arc-shaped bottom edge 57*b*. The groove 57 has a width larger than the diameter of the rotation shaft 39 considering the backlash between the rotation shaft 39 and the groove 57.

Apart of the outer circumferential edge (the first arc-shaped edge 77, for example) of the adjustment part 73 of the adjustment plate 65 is exposed through an innermost portion of the groove 57 obliquely from the front lower side.

In the third embodiment, the right end portion of the rotation shaft 39 of the photosensitive drum 31 is inserted into the groove 57 and comes into contact with the lower side edge 57*a* of the groove 57 and the outer circumferential edge of the adjustment part 73 of the adjustment plate 65. Additionally, the pressing lever 41 is engaged with the right side plate 29*d*, and the right end portion of the rotation shaft 39 is biased horizontally by the spring 43. A wedge member 44 is arranged between the spring 43 and the rotation shaft 39, and inverts the horizontal biasing direction of the spring 43 into an oblique front upper direction. Then, the right end portion of the rotation shaft 39 is biased in the oblique front upper direction and pressed to the upper side edge 57*a* of the groove 57, as shown in a white blank arrow in FIG. 17.

As described above, the right end portion of the rotation shaft 39 is positioned by the upper side edge 57*a*, the outer circumferential edge (the first arc-shaped edge 77) and the spring 43 (the wedge member 44).

When the rotation shaft 39 is shifted, the dial gear 67 is operated such that the adjustment plate 65 is rotated in a direction where the radius of the adjustment part 73 becomes larger. Then, as shown by a broken line and a two-dotted chain line in FIG. 17, the rotation shaft 39 is shifted rearward along the upper side edge 57*a* while being pressed by the spring 43. That is, the rotation shaft 39 is shifted rearward horizontally.

In the case where the drum units 23 are arranged in parallel in the upper- and lower direction, the laser light is often incident from the exposure device 19 in an approximately horizontal direction. In this case, in FIG. 15, the Y direction shows the horizontal direction and the X direction shows the vertical direction. In the third embodiment, the rotation shaft 39 is shifted horizontally so that the skew adjustment sensitivity is set to be low.

In the third embodiment, a part of the outer circumferential edge of the adjustment part 73 of the adjustment plate 65 may be exposed through the innermost portion of the groove 57 obliquely from the front upper direction. In this case, the right end portion of the rotation shaft 39 is biased by the spring 43 and comes into contact with the lower side edge 57*a* of the groove 57 and the outer circumferential edge of the adjustment part 73 of the adjustment plate 65. Thereby, the right end portion of the rotation shaft 39 is positioned by the lower side edge 57*a* of the groove 57, the outer circumferential edge of the adjustment part 73 and the spring 43.

As described in the embodiments 1 to 3, by rotating the adjustment plate 65 to change the contact position of the outer circumferential edge of the adjustment part 73 with the rotation shaft 39, it becomes possible to shift the right end portion of the rotation shaft 39 obliquely or horizontally. That is, by selecting the shift direction of the rotation shaft 39, it becomes possible to select the skew adjustment sensitivity depending on the degree of the skew. Accordingly, it becomes possible to adjust the skew effectively.

The shift distance of the rotation shaft 39 may be adjusted by the radius of the adjustment part 73 of the adjustment plate 65. In the first embodiment, when the right end portion of the rotation shaft 39 is shifted obliquely, a shift direction and a shift distance may be adjusted depending on the inclining angle θ1 of the inclined part 57*d* of the groove 57.

While the above description has been described with reference to the particular illustrative embodiments of the image forming apparatus according to the present disclosure, a technical range of the disclosure is not to be restricted by the description and illustration of the embodiment.

The invention claimed is:

1. An image forming apparatus comprising:

a groove in which an end portion of a rotation shaft of a photosensitive drum is inserted;

an exposure device configured to emit a laser light on the photosensitive drum to form an electrostatic latent image; and an adjustment member configured to shift the end portion of the rotation shaft in a direction other than a vertical direction in the groove to adjust a skew of the laser light, wherein the groove has a linear inclined part, the adjustment member is rotatable and has an arc-shaped circumferential edge configured to come into contact with the end portion of the rotation shaft inserted in the groove from an oblique lower direction, to press the end portion of the rotation shaft on the inclined part and to support the end portion of the rotation shaft with the inclined part, wherein the circumferential edge is configured such that a radius is varied along a circumferential direction, and when the adjustment member is rotated, a contact position of the circumferential edge with the end portion of the rotation shaft is varied and then the end portion of the rotation shaft is shifted along the inclined part.

2. The image forming apparatus according to claim 1, wherein the groove is formed along the vertical direction, and the inclined part is formed at a corner between a bottom edge and one of side edges of the groove.

3. The image forming apparatus according to claim 1, further comprising a biasing member configured to bias the end portion of the rotation shaft inserted in the groove downward.

4. An image forming apparatus comprising:

a groove in which an end portion of a rotation shaft of a photosensitive drum is inserted;

an exposure device configured to emit a laser light on the photosensitive drum to form an electrostatic latent image; and an adjustment member configured to shift the end portion of the rotation shaft in a direction other than a vertical direction in the groove to adjust a skew of the laser light, wherein the groove has a linear horizontal part, the adjustment member is rotatable and has an arc-shaped circumferential edge configured to come into contact with the end portion of the rotation shaft inserted in the groove from an oblique direction, to press the end portion of the rotation shaft on the horizontal part and to support the end portion of the rotation shaft with the horizontal part, wherein a biasing member is provided, the biasing member being configured to bias the end portion of the rotation shaft inserted in the groove so as to press the end portion of the rotation shaft on the horizontal part and the circumferential edge, wherein the circumferential edge is configured such that a radius is varied along a circumferential direction, and when the adjustment member is rotated, a contact position of the circumferential edge with the end portion of the rotation shaft is varied and then the end portion of the rotation shaft is shifted along the horizontal part.

5. The image forming apparatus according to claim 4, wherein the groove is formed along the vertical direction, and the horizontal part is formed along a bottom edge of the groove.

6. The image forming apparatus according to claim 4, wherein the groove is formed along a horizontal direction, and the horizontal part is formed along an upper side edge or a lower side edge of the groove.

* * * * *